US008465604B2

(12) United States Patent
Ishii et al.

(10) Patent No.: US 8,465,604 B2
(45) **Date of Patent: *Jun. 18, 2013**

(54) FERRITIC STAINLESS STEEL SHEET HAVING EXCELLENT CORROSION RESISTANCE AND METHOD OF MANUFACTURING THE SAME

(75) Inventors: Kazuhide Ishii, Tokyo (JP); Tomohiro Ishii, Tokyo (JP); Osamu Furukimi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 458 days.

This patent is subject to a terminal disclaimer.

(21) Appl. No.: 11/918,375

(22) PCT Filed: Jul. 31, 2006

(86) PCT No.: PCT/JP2006/315540

§ 371 (c)(1),
(2), (4) Date: Oct. 12, 2007

(87) PCT Pub. No.: WO2007/020826

PCT Pub. Date: Feb. 22, 2007

(65) Prior Publication Data

US 2009/0056838 A1 Mar. 5, 2009

(30) Foreign Application Priority Data

Aug. 17, 2005 (JP) ..... 2005-236861

(51) Int. Cl.
*C21D 8/00* (2006.01)
*C22C 38/20* (2006.01)

(52) U.S. Cl.
USPC ..... 148/610; 148/506; 148/507; 148/332; 420/90

(58) Field of Classification Search
USPC ..... 148/607–610, 325, 326, 506, 507, 148/332; 420/60, 61, 70, 90
See application file for complete search history.

(56) References Cited

U.S. PATENT DOCUMENTS

| | | | | | |
|---|---|---|---|---|---|
| 4,713,154 | A * | 12/1987 | Ohta et al. | ..... | 148/606 |
| 6,113,710 | A * | 9/2000 | Kato et al. | ..... | 148/325 |
| 6,911,098 | B2 * | 6/2005 | Yazawa et al. | ..... | 148/325 |
| 7,056,398 | B2 * | 6/2006 | Yazawa et al. | ..... | 148/610 |
| 7,494,551 | B2 * | 2/2009 | Yazawa et al. | ..... | 148/326 |
| 2005/0211348 | A1 * | 9/2005 | Miyazaki et al. | ..... | 148/609 |
| 2007/0144634 | A1 * | 6/2007 | Miyazaki et al. | ..... | 148/610 |

FOREIGN PATENT DOCUMENTS

| | | | |
|---|---|---|---|
| JP | 50-6167 | | 1/1975 |
| JP | 56-146859 | A | 11/1981 |
| JP | 64-4576 | A | 1/1989 |
| JP | 8-260104 | A | 10/1996 |
| JP | 9-279231 | A | 10/1997 |
| JP | 2000-144258 | * | 5/2000 |
| JP | 2005-89828 | A | 4/2005 |

OTHER PUBLICATIONS

English translation of Hirasawa et al—JP 2000-144258 , Published May 26, 2000, 23 pages.*

* cited by examiner

*Primary Examiner* — Jessee R. Roe
(74) *Attorney, Agent, or Firm* — RatnerPrestia

(57) ABSTRACT

A ferritic stainless steel sheet having excellent corrosion resistance and a method of manufacturing the steel sheet are provided. Specifically, the ferritic stainless steel sheet of the invention contains C of 0.03% or less, Si of 1.0% or less, Mn of 0.5% or less, P of 0.04% or less, S of 0.02% or less, Al of 0.1% or less, Cr of 20.5% to 22.5%, Cu of 0.3% to 0.8%, Ni of 1.0% or less, Ti of 4×(C %+N %) to 0.35%, Nb of less than 0.01%, N of 0.03% or less, and C+N of 0.05% or less, and has the remainder including Fe and inevitable impurities, wherein $240+35\times(Cr\ \%-20.5)+280\times\{Ti\ \%-4\times(C\ \%+N\ \%)\}\geqq 280$ is satisfied.

4 Claims, 1 Drawing Sheet

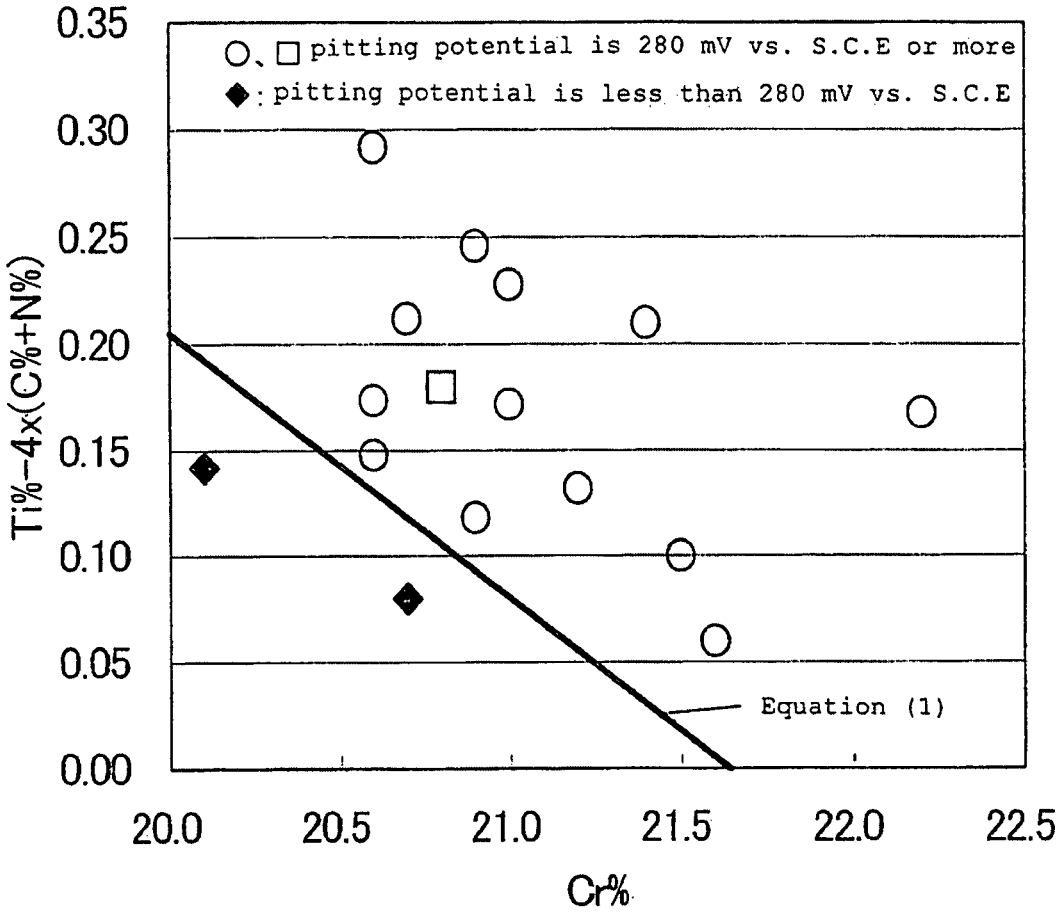
○、□ pitting potential is 280 mV vs. S.C.E or more
◆: pitting potential is less than 280 mV vs. S.C.E
Equation (1)
Ti%−4x(C%+N%)
Cr%
0.35
0.30
0.25
0.20
0.15
0.10
0.05
0.00
20.0
20.5
21.0
21.5
22.0
22.5

FERRITIC STAINLESS STEEL SHEET HAVING EXCELLENT CORROSION RESISTANCE AND METHOD OF MANUFACTURING THE SAME

RELATED APPLICATION

This is a §371 of International Application No. PCT/JP2006/315540, with an international filing date of Jul. 31, 2006 (WO 2007/020826 A1, published Feb. 22, 2007), which is based on Japanese Patent Application No. 2005-236861, filed Aug. 17, 2005.

TECHNICAL FIELD

This disclosure relates to a ferritic stainless steel sheet having excellent corrosion resistance, and a method of manufacturing the steel sheet.

BACKGROUND

Among various types of stainless steel, SUS304 (18% Cr-8% Ni) (Japanese Industrial Standards, JIS G 4305) of austenitic stainless steel is widely used because of excellent corrosion resistance of the steel. However, this steel type is expensive because it contains a large quantity of Ni. On the other hand, in ferritic stainless steel that contains a large quantity of Ni, SUS436L (18% Cr-1% Mo) (JIS G 4305) containing Mo is given as a steel type having excellent corrosion resistance equivalent to SUS304. However, since Mo is an expensive element, cost is significantly increased even if only 1% of Mo is added.

From the above, ferritic stainless steel having corrosion resistance equivalent to SUS304 or SUS436L is required without the addition of Mo. While SUS430J1L (19% Cr–0.5% Cu-0.4% Nb) (JIS G 4305) is given as the ferritic stainless steel without addition of Mo, it is inferior in corrosion resistance compared to SUS304 or SUS436L.

On the contrary, JP-B-50-6167 discloses ferritic stainless steel having a characteristic composition of Cr of 9 to 30%, Cu of 0.1 to 0.6%, Ti of 5×C % to 15×C %, and Sb of 0.02 to 0.2%; and JP-B-64-4576 (JP-A-60-46352) discloses ferritic stainless steel having a characteristic composition of Cr of 11 to 23%, Cu of 0.5 to 2.0%, at least one of Ti, Nb, Zr and Ta in a ratio of 0.01 to 1.0%, and V of 0.05 to 2.0%. Further, Japanese Patent No. 3420371 (JP-A-8-260104) discloses stainless steel having a characteristic composition of Cr of 5 to 60%, Cu of 0.15 to 3.0%, Ti of 4×(C %+N %) to 0.5%, and Nb of 0.003 to 0.020% as a composition.

However, the JP-B-50-6167, JP-B-64-4576, and Japanese Patent No. 3420371 do not disclose compositions that combine highly efficient productivity by continuous annealing of a hot-rolled sheet and high speed continuous annealing of a cold-rolled sheet, with excellent corrosion resistance equivalent to SUS304 or SUS436L.

It is necessary for manufacturing the steel at low cost that expensive Mo is not added and, in addition, the steel can be mass-produced at high efficiency. While corrosion resistance is improved with increase in addition of Cr, toughness of a hot-rolled sheet is reduced.

While a hot-rolled sheet of high-Cr ferritic stainless steel sheet needs to be subjected to annealing and pickling in a continuous annealing and pickling line before cold rolling, when the hot-rolled sheet has low toughness, sometimes it can not be subjected to a continuous process in the continuous annealing and pickling line. Furthermore, in light of the desire for highly efficient productivity, it is necessary that a cold-rolled sheet can be efficiently annealed in a high speed continuous annealing line for cold-rolled sheet for combined use with carbon steel.

It could therefore be advantageous to provide a ferritic stainless steel sheet that can be manufactured inexpensively and highly efficiently, and has excellent corrosion resistance.

SUMMARY

We conducted studies on methods of obtaining a stainless steel sheet having excellent corrosion resistance without containing expensive Ni and Mo. As a result, we found that Cr was limited in a range of 20.5% to 22.5% from a viewpoint of corrosion resistance and productivity, and the amount of carbon or nitrogen as an impurity element was decreased, and furthermore an appropriate amount of Ti was added. A stainless steel sheet having excellent corrosion resistance equivalent to SUS304 or SUS436L was obtained. Continuous annealing of a hot-rolled sheet and annealing of a cold-rolled sheet in a high speed continuous annealing line for cold-rolled sheet were able to be performed. Consequently, the cold-rolled sheet was able to be produced highly efficiently.

We thus provide a ferritic stainless steel sheet having excellent corrosion resistance, the sheet containing C of 0.03% or less, Si of 1.0% or less, Mn of 0.5% or less, P of 0.04% or less, S of 0.02% or less, Al of 0.1% or less, Cr of 20.5% to 22.5%, Cu of 0.3% to 0.8%, Ni of 1.0% or less, Ti of 4×(C %+N %) to 0.35%, Nb of less than 0.01%, N of 0.03% or less, and C+N of 0.05% or less, and having the remainder including Fe and inevitable impurities, wherein the following equation (1) is satisfied, $$240+35\times(Cr\,\%-20.5)+280\times\{Ti\,\%-4\times(C\,\%+N\,\%)\}\geqq 280 \quad (1),$$

wherein C %, N %, Cr % and Ti % indicate the content (mass percent) of C, N, Cr and Ti respectively.

We also provide a method of manufacturing a ferritic stainless steel sheet having excellent corrosion resistance, in which a stainless steel sheet is used as a material, the slab containing C of 0.03% or less, Si of 1.0% or less, Mn of 0.5% or less, P of 0.04% or less, S of 0.02% or less, Al of 0.1% or less, Cr of 20.5% to 22.5%, Cu of 0.3% to 0.8%, Ni of 1.0% or less, Ti of 4×(C %+N %) to 0.35%, Nb of less than 0.01%, N of 0.03% or less, and C+N of 0.05% or less, and having the remainder including Fe and inevitable impurities, wherein the following equation (1) is satisfied, and the material is hot-rolled, then a hot-rolled material is subjected to continuous annealing for hot-rolled sheet at a temperature of 800 to 1000° C. and then pickled, and then formed into a cold-rolled annealed sheet through steps of cold rolling, finish annealing, cooling and pickling, $$240+35\times(Cr\,\%-20.5)+280\times\{Ti\,\%-4\times(C\,\%+N\,\%)\}\geqq 280 \quad (1),$$

wherein C %, N %, Cr % and Ti % indicate the content of C, N, Cr and Ti (mass percent) respectively.

Percent (%) indicates a component ratio of steel in mass percent.

The ferritic stainless steel sheet having excellent corrosion resistance equivalent to SUS304 or SUS436L is obtained without adding expensive Mo and the like. Moreover, the stainless steel sheet can be produced highly efficiently, and inexpensively because expensive Ni or Mo is not added.

Furthermore, since the stainless steel sheet has decreased quantities of impurity elements, and added with Ti as a stabilizing element for fixing C or N in steel, it is excellent in weldability, workability of welding areas, and corrosion resistance of welding areas.

BRIEF DESCRIPTION OF THE DRAWINGS

FIG. 1 is a view showing a relationship between Cr % and Ti %−4×(C %+N %), and a result of neutral salt spray cycle testing.

DETAILED DESCRIPTION

Representative compositions of our steels are described.

C: 0.03% or less, N: 0.03% or less, and C+N: 0.05% or less

The content of C and N is desirably low because they reduce toughness of a hot-rolled sheet, and therefore limited to be 0.03% or less respectively, and limited to be 0.05% or less even in total. Further preferably, the content of C is 0.015% or less, the content of N is 0.015% or less, and the content of C+N is 0.03% or less.

Si: 1.0% or less

Si is a necessary element as a deoxidizing agent. To obtain the effect of Si, the Si content is preferably 0.03% or more. However, when a large quantity of Si is added, toughness of a hot-rolled sheet is reduced. Accordingly, the Si content is 1.0% or less. More preferably, it is 0.3% or less.

Mn: 0.5% or less

Mn has a deoxidizing effect. To obtain the effect, the Mn content is preferably 0.05% or more. However, since Mn forms sulfides in steel, which significantly reduce corrosion resistance, the quantity of addition of Mn is desirably low and, in light of economic efficiency in manufacturing, the Mn content is defined to be 0.5% or less. More preferably, it is 0.3% or less.

P: 0.04% or less

The P content is desirably low from a viewpoint of workability in hot working, and it is defined to be 0.04% or less.

S: 0.02% or less

The S content is desirably low from a viewpoint of workability in hot working and corrosion resistance, and it is defined to be 0.02% or less. More preferably, it is 0.005% or less.

Al: 0.1% or less

Al is an effective component for deoxidization. To obtain the effect, the Al content is preferably 0.005% or more. However, when Al is excessively added, surface flaws are induced and workability is reduced due to an increase in Al-based nonmetallic inclusions. Accordingly, the Al content is defined to be 0.1% or less. More preferably, it is 0.01% to 0.05%.

Cr: 20.5% to 22.5%

Cr is an important element in our steels. It is effective for improving corrosion resistance, and Cr of 20.5% or more is added to obtain the corrosion resistance equivalent to SUS304 or SUS436L. On the other hand, when Cr of more than 22.5% is added, toughness of a hot-rolled sheet is reduced. Consequently, continuous annealing of a hot-rolled sheet is difficult. Accordingly, the Cr content is defined to be 20.5% to 22.5%. More preferably, it is 20.5% to 21.5%.

Cu: 0.3% to 0.8%

Cu is an important element. It is an element necessary for reducing crevice corrosion. For the purpose, Cu of at least 0.3% needs to be added. On the other hand, when the Cu content exceeds 0.8%, workability in hot working is reduced. Accordingly, the Cu content is defined to be 0.3% to 0.8%. More preferably, it is 0.3% or more and less than 0.5%.

Ni: 1.0% or less

Ni has an effect of preventing reduction in workability in hot working due to addition of Cu. To obtain the effect, the Ni content of 0.05% or more is preferable. However, Ni is an expensive element, in addition, even if Ni of more than 1.0% is added, the effect is saturated. Accordingly, the Ni content is defined to be 1.0% or less. More preferably, it is 0.1% to 0.4%.

Ti: 4×(C %+N %) to 0.35%

Ti is also an important element. It is an essential element to be added and necessary to obtain the excellent corrosion resistance equivalent to SUS304 or SUS436L in addition of Cr of 22.5% or less. Ti has been recognized as an element having an effect that it forms TiC or TiN with C or N, which is harmful for workability or corrosion resistance of welding area, thereby makes C or N harmless and thus improves corrosion resistance. Ti has the effect of directly increasing pitting potential and thus improving corrosion resistance. Furthermore, Ti is added to prevent sensitization due to continuous annealing. To obtain the effects, Ti of 4×(C %+N %) or more needs to be added. On the other hand, when an excessive quantity of T of more than 0.35% is added, toughness of a hot-rolled sheet is reduced. Accordingly, the Ti content is defined to be 4×(C %+N %) or more and 0.35% or less. More preferably, it is 8×(C %+N %) or more and 0.30% or less.

Nb: 0.01% or less

Nb increases the recrystallization temperature, causing insufficient annealing in the high speed annealing line for cold-rolled sheet. Consequently, certain workability can not be ensured. Accordingly, the Nb content is defined to be 0.01% or less. More preferably, it is 0.005% or less.

$$240+35\times(\text{Cr }\%-20.5)+280\times\{\text{Ti }\%-4\times(\text{C }\%+\text{N }\%)\}\geqq 280$$

Cr, Ti, C and N are defined to satisfy the relationship of the equation (1) to obtain excellent corrosion resistance equivalent to SUS304 or SUS436L or more without containing Ni and Mo, $$240+35\times(\text{Cr }\%-20.5)+280\times\{\text{Ti }\%-4\times(\text{C }\%+\text{N }\%)\}\geqq 280 \quad (1).$$

While Cr and Ti have the effect of increasing pitting potential respectively, only addition of Cr of 20.5% or more and the Ti of 4×(C %+N %) or more is insufficient to obtain the corrosion resistance equivalent to SUS304 or SUS436L or more, and the Cr content and the Ti content further need to satisfy the equation (1) with the C content and the N content being considered. The equation (1) is derived from a relationship between the Cr and Ti content, and pitting potential (mV vs. S.C.E), and shows minimum values of the Cr content and the Ti content above which a value of pitting potential is at least 280 mV that is a typical value of pitting potential of SUS304 or SUS436L. Moreover, since dissolved Ti other than Ti bound as TiC or TiN exhibits an effect of increasing pitting potential, {Ti %-4×(C %+N %)} corresponding to the quantity of dissolved Ti is used in the equation (1).

Mo: 0.2% or less

While Mo is an element for improving corrosion resistance, it is an expensive element. In addition, it reduces toughness of a hot-rolled sheet, causing difficulty in manufacturing. It furthermore increases the hardness of a cold-rolled annealed sheet, and therefore reduces workability. Therefore, the Mo content is defined to be 0.2% or less. More preferably, it is 0.1% or less.

In addition, the following elements can be added as necessary.

B: 0.0002 to 0.002%

B is an element effective for improving cold-work embrittlement after deep drawing. The effect is not obtained in the content of less than 0.0002%, and excessive addition of B reduces workability in hot working and deep drawability. Therefore, B is preferably added in the quantity of 0.0002 to 0.002%.

V: 0.01 to 0.5%, Zr: 0.01 to 0.5%

V and Zr have an effect of preventing occurrence of intergranular corrosion in a welding area by making C or N harmless. The effect is not exhibited in the content of V and Zr of less than 0.005% respectively, and each of them needs to be added in the quantity of 0.01% or more. However, when V and Zr are added in the quantity of more than 0.5% respectively, toughness of a hot-rolled sheet is reduced, causing difficulty in manufacturing. Furthermore, V and Zr bind with C, N or O (oxygen) to form inclusions, leading to increase in surface defects. Therefore, they are defined to be 0.5% or less respectively.

The remainder of the composition except for the above components is Fe and inevitable impurities.

Next, a representative method of manufacturing the ferritic stainless steel sheet having excellent corrosion resistance is described.

As a highly efficient manufacturing method of the steel, a method is recommended in which a slab is formed by continuous casting. Then, the slab is heated to 1100 to 1250° C. and hot-rolled to be formed into a hot-rolled coil, which is then annealed at a temperature of 800 to 1000° C. and then pickled in a continuous annealing and pickling line for hot-rolled sheet, and then subjected to cold rolling to be formed into a cold-rolled sheet, which is then efficiently annealed and pickled in a high speed continuous annealing line for cold-rolled sheet for combined use with carbon steel.

In particular, the method is described as follows.

First, molten steel is prepared, which is controlled in the chemical composition range by secondary refining using a converter, an electric furnace or the like, together with a strong-stirring, vacuum oxygen decarburization (VOD) process or an argon oxygen decarburization (AOD) process. Then, a slab is ingoted from the molten steel by continuous casting or ingot casting. As a casting method, continuous casting is preferable in the light of productivity and slab quality.

The slab obtained by casting is reheated to 1100 to 1250° C. as necessary, then hot-rolled such that a thickness of 2.0 mm to 6.0 mm is obtained. Then, a hot-rolled sheet is subjected to continuous annealing at a temperature of 800 to 1000° C. and pickled.

The pickled hot-rolled sheet is sequentially subjected to steps of cold rolling, finish annealing, cooling, and pickling so that a cold-rolled annealed sheet having a thickness of 0.03 mm to 5.0 mm is formed.

The reduction rate in cold rolling is preferably at least 25% to secure mechanical properties such as toughness and workability. More preferably, it is at least 50%. Moreover, the cold rolling may be performed one time or at least two times including intermediate annealing. Respective steps of the cold rolling, finish annealing, and pickling may be repeatedly performed. Furthermore, a method is recommended in which a cold-rolled sheet is efficiently annealed and pickled in the high speed continuous annealing line for cold-rolled sheet for combined use with carbon steel. Moreover, while productivity is reduced, the cold-rolled sheet may be annealed and pickled in a typical annealing and pickling line for cold-rolled sheet of stainless steel. Moreover, the cold-rolled sheet may be subjected to bright annealing in a bright annealing line as necessary.

In the case of welding the steel sheet as described hereinbefore, all the typical welding methods can be used, such as arc welding including TIG (tungsten inert gas welding) and MIG (metal inert gas welding), resistance welding such as seam welding and spot welding, and laser welding.

Example 1

Ferritic stainless steel having compositions as shown in Table 1 was ingoted into 30 kg steel ingots, then the ingots were heated to a temperature of 1150° C. and hot rolled, thereby hot-rolled sheets having a thickness of 2.5 to 2.8 mm were obtained. The addition of Mo was controlled in a level of being expected to be mixed as an impurity in real operation. Test pieces (JIS B 7722 V notch) were taken out from obtained hot-rolled sheets in a rolling direction and subjected to the Charpy impact test. A comparative example 11 having a high Cr content of 22.8% that is out of our range, and a comparative example 12 having a high Ti: content of 0.39% that is out of our range were low in toughness and thus hard to be subjected to continuous annealing for hot-rolled sheet in real operation, therefore they were not subjected to subsequent tests.

Specimens other than comparative examples 11 and 12 were annealed at 950° C., then cold-rolled, so that cold-rolled sheets 0.8 mm in thickness were prepared. Then, the cold-rolled sheets were annealed at 880° C. in the air. In a comparative example 13 having a high Nb content of 0.15% that is out of our range, steel was insufficiently annealed at the temperature and therefore elongation was less than 20%, consequently sufficient workability was not able to be secured in cold-rolled-sheet annealing in the high speed continuous annealing line for cold-rolled sheet, therefore subsequent tests were not performed.

Test pieces taken from specimens (examples of the invention 1 to 8, and 21 to 25) other than the comparative examples 11 to 13 obtained according to the above, and test pieces taken from cold-rolled annealed sheets 0.8 mm in thickness of SUS304, SUS436L and SUS430J1L were subjected to measurement of pitting potential at 30° C. in 3.5% NaCl solution according to JIS G 0577, and subjected to neutral salt spray cycle testing. The neutral salt spray cycle testing was performed 45 cycles to specimens (20 mm×30 mm in size) having a polished surface using a No. 600 abrasive paper with steps of neutral salt spray (5% NaCl, 35° C., and spray time of 2 hr), drying (60° C., 4 hr, and relative humidity of 40%), and wetting (50° C., 2 hr, and relative humidity of 95% or more) as one cycle. The obtained results are collectively shown in Table 1.

Next, crevice corrosion testing was performed to specimens (examples of the invention 1 to 8, and 21 to 25), SUS304, and SUS436L other than the comparative examples 11 to 15 and SUS430J1L. Flat plates of 60 mm wide and 80 mm long, and 20 mm wide and 30 mm long taken out from each of specimens were used, wherein their surfaces were polished using No. 600 abrasive paper, then the flat plate of 20 mm wide and 30 mm long was placed on the flat plate of 60 mm wide and 80 mm long such that respective diagonals overlapped, and then respective center points were bonded by spot welding to form a crevice structure. Such test pieces were subjected to 90 cycles of neutral salt spray cycle testing, then spot welding areas were removed and crevice portions were opened so that depth of corrosion pitting was measured by a laser microscope. The results obtained are collectively shown in Table 1.

In Table 1, a criterion of each test is as follows:

(1) Charpy impact test: a test piece having absorbed energy at 25° C. of 50 J/cm$^2$ or more was determined as O (pass), and a test piece having the energy of less than 50 J/cm$^2$ was determined as x (reject).

(2) Cold-rolled sheet annealing: a test piece having elongation after annealing at 880° C. of 20% or more was determined as O (pass), and a test piece having elongation after annealing at 880° C. of less then 20% was determined as x (reject).

(3) Neutral salt spray cycle testing: with respect to one side (60×80 mm) of a test piece, a test piece having rust area of less than 20% was determined as O (pass), and a test piece having rust area of 20% or more was determined as x (reject).

(4) Crevice corrosion testing result: in corrosion pitting produced in a crevice portion of a test piece, when ten points of the pitting having large depth have an average value of depth of less than 300 μm, the test piece was determined as O (pass), and when they have the average value of depth of more than 300 μm, the test piece was determined as x (reject). Depth of the corrosion pitting was measured by the laser microscope.

It is known from Table 1 that our examples have pitting potential equivalent to SUS304 or SUS436L or more, and show excellent results of the neutral salt spray cycling testing. That is, the examples have excellent corrosion resistance. Moreover, they show average depth of corrosion pitting of less than 300 μm in the crevice corrosion testing. That is, they further have excellent crevice corrosion resistance.

On the other hand, in comparative example 14 having the low Cr content of 20.1% that is out of our range, and comparative example 15 that does not satisfy the equation (1), pitting potential was low compared with SUS304 or SUS436L, in addition, rust area was large in the neutral salt spray testing. That is, corrosion resistance was bad.

FIG. 1 shows the relationship between pitting potential, and Cr % and Ti %−4×(C %+N %) in our examples 1 to 8, and 21 to 25 and comparative examples 14, 15 and 16. As seen from FIG. 1, to obtain the pitting potential of 280 mV corresponding to SUS304 or SUS436L or more, it is necessary to satisfy the equation (1), $240+35\times(Cr\ \%-20.5)+280\times\{Ti\ \%-4\times(C\ \%+N\ \%)\}\geqq 280$.

Furthermore, in comparative example 16 that does not contain Cu, average depth of corrosion pitting in the crevice corrosion testing is 300 μm or more, that is, crevice corrosion resistance is poor compared with the examples 1 to 8 and 21 to 25, SUS304, and SUS436L.

From the above, in our examples, a hot-rolled sheet was able to be subjected to continuous annealing, and elongation at 880° C. was 20% or more. Therefore, the cold-rolled sheet was able to be annealed in the high speed continuous annealing line for cold-rolled sheet. Consequently, the cold-rolled sheet was able to be produced at high efficiency. Moreover, it was found that the examples of the invention had excellent corrosion resistance equivalent to SUS304 or SUS436L.

INDUSTRIAL APPLICABILITY

Our steels and methods are preferable for members required to have corrosion resistance, mainly including containers for marine transportation, vessels, kitchen instruments, interior and exterior building materials, automobile parts, elevators, escalators, railcars, and outer panels of electric apparatus.

TABLE 1

| | | Composition (mass percent) | | | | | | | | | | | | |
|---|---|---|---|---|---|---|---|---|---|---|---|---|---|---|
| | | C | Si | Mn | P | S | Al | Cr | Ni | Cu | Mo | Ti | Nb | N |
| Example of the Invention | 1 | 0.006 | 0.17 | 0.18 | 0.030 | 0.003 | 0.035 | 20.6 | 0.32 | 0.46 | 0.02 | 0.25 | 0.001 | 0.013 |
| | 2 | 0.011 | 0.23 | 0.15 | 0.029 | 0.003 | 0.035 | 20.9 | 0.28 | 0.46 | 0.03 | 0.21 | 0.004 | 0.012 |
| | 3 | 0.003 | 0.11 | 0.07 | 0.026 | 0.001 | 0.015 | 21.6 | 0.11 | 0.32 | 0.01 | 0.10 | 0.001 | 0.007 |
| | 4 | 0.014 | 0.13 | 0.16 | 0.030 | 0.003 | 0.036 | 20.9 | 0.31 | 0.41 | 0.05 | 0.35 | 0.004 | 0.012 |
| | 5 | 0.010 | 0.11 | 0.17 | 0.029 | 0.004 | 0.026 | 22.2 | 0.16 | 0.32 | 0.03 | 0.24 | 0.010 | 0.008 |
| | 6 | 0.008 | 0.18 | 0.16 | 0.031 | 0.003 | 0.032 | 21.0 | 0.27 | 0.48 | 0.04 | 0.24 | 0.001 | 0.009 |
| | 7 | 0.017 | 0.07 | 0.11 | 0.027 | 0.001 | 0.047 | 21.4 | 0.31 | 0.58 | 0.03 | 0.33 | 0.007 | 0.013 |
| | 8 | 0.005 | 0.29 | 0.12 | 0.033 | 0.002 | 0.015 | 21.2 | 0.13 | 0.45 | 0.09 | 0.18 | 0.002 | 0.007 |
| | 21 | 0.014 | 0.07 | 0.17 | 0.031 | 0.002 | 0.054 | 21.5 | 0.30 | 0.43 | 0.06 | 0.20 | 0.001 | 0.011 |
| | 22 | 0.009 | 0.09 | 0.19 | 0.028 | 0.001 | 0.039 | 20.7 | 0.28 | 0.43 | 0.01 | 0.28 | 0.001 | 0.008 |
| | 23 | 0.005 | 0.05 | 0.20 | 0.024 | 0.002 | 0.046 | 20.6 | 0.24 | 0.49 | 0.03 | 0.34 | 0.003 | 0.007 |
| | 24 | 0.010 | 0.08 | 0.22 | 0.029 | 0.001 | 0.040 | 21.0 | 0.30 | 0.41 | 0.04 | 0.30 | 0.003 | 0.008 |
| | 25 | 0.006 | 0.11 | 0.21 | 0.023 | 0.001 | 0.038 | 20.5 | 0.31 | 0.42 | 0.05 | 0.20 | 0.001 | 0.007 |
| Comparative example | 11 | 0.018 | 0.05 | 0.14 | 0.031 | 0.001 | 0.033 | 22.8 | 0.22 | 0.41 | 0.02 | 0.25 | 0.001 | 0.013 |
| | 12 | 0.022 | 0.22 | 0.16 | 0.029 | 0.002 | 0.020 | 21.5 | 0.22 | 0.42 | 0.03 | 0.39 | 0.001 | 0.018 |
| | 13 | 0.016 | 0.27 | 0.17 | 0.033 | 0.003 | 0.025 | 21.2 | 0.26 | 0.44 | 0.03 | 0.22 | 0.15 | 0.012 |
| | 14 | 0.008 | 0.12 | 0.16 | 0.028 | 0.003 | 0.021 | 20.1 | 0.14 | 0.35 | 0.01 | 0.23 | 0.004 | 0.014 |
| | 15 | 0.008 | 0.11 | 0.15 | 0.032 | 0.004 | 0.025 | 20.7 | 0.16 | 0.32 | 0.03 | 0.14 | 0.002 | 0.007 |
| | 16 | 0.009 | 0.12 | 0.18 | 0.030 | 0.004 | 0.029 | 20.8 | 0.12 | 0.01 | 0.01 | 0.26 | 0.002 | 0.011 |
| | SUS304 | 0.054 | 0.44 | 1.05 | 0.025 | 0.003 | <0.004 | 18.2 | 8.01 | 0.22 | 0.09 | 0.01 | 0.003 | 0.041 |
| | SUS436 | 0.008 | 0.09 | 0.12 | 0.030 | 0.001 | 0.044 | 17.7 | 0.13 | 0.02 | 1.1 | 0.31 | 0.002 | 0.011 |
| | SUS430 J1L | 0.010 | 0.46 | 0.17 | 0.028 | 0.005 | <0.004 | 19.2 | 0.34 | 0.52 | 0.04 | <0.01 | 0.42 | 0.009 |

| | | Ti − 4 × (C + N) | Charpy test result of hot-rolled sheet | Cold-rolled sheet annealing | Value of equation (1) | Pitting potential (mV vs. S.C.E) | Neutral salt spray cycle testing result | Crevice corrosion testing result |
|---|---|---|---|---|---|---|---|---|
| Example of the Invention | 1 | 0.174 | ○ | ○ | 292 | 306 | ○ | ○ |
| | 2 | 0.118 | ○ | ○ | 287 | 287 | ○ | ○ |
| | 3 | 0.060 | ○ | ○ | 295 | 288 | ○ | ○ |
| | 4 | 0.246 | ○ | ○ | 323 | 328 | ○ | ○ |
| | 5 | 0.168 | ○ | ○ | 347 | 353 | ○ | ○ |
| | 6 | 0.172 | ○ | ○ | 306 | 290 | ○ | ○ |
| | 7 | 0.210 | ○ | ○ | 330 | 323 | ○ | ○ |
| | 8 | 0.132 | ○ | ○ | 301 | 311 | ○ | ○ |
| | 21 | 0.100 | ○ | ○ | 303 | 297 | ○ | ○ |
| | 22 | 0.212 | ○ | ○ | 306 | 310 | ○ | ○ |
| | 23 | 0.292 | ○ | ○ | 325 | 311 | ○ | ○ |

TABLE 1-continued

| | | | | | | | | |
|---|---|---|---|---|---|---|---|---|
| | 24 | 0.228 | ○ | ○ | 321 | 328 | ○ | ○ |
| | 25 | 0.148 | ○ | ○ | 281 | 295 | ○ | ○ |
| Comparative example | 11 | 0.126 | x | — | — | — | — | — |
| | 12 | 0.230 | x | — | — | — | — | — |
| | 13 | 0.108 | ○ | x | — | — | — | — |
| | 14 | 0.142 | ○ | ○ | 266 | 268 | x | — |
| | 15 | 0.080 | ○ | ○ | 269 | 266 | x | — |
| | 16 | 0.180 | ○ | ○ | 301 | 290 | ○ | x |
| | SUS304 | — | — | — | — | 287 | ○ | ○ |
| | SUS436 | — | — | — | — | 281 | ○ | ○ |
| | SUS430 J1L | — | — | — | — | 251 | x | — |

The invention claimed is:

1. A ferritic stainless steel sheet having excellent corrosion resistance consisting of:

C of 0.03% or less,
Si of 1.0% or less,
Mn of 0.5% or less,
P of 0.04% or less,
S of 0.02% or less,
Al of 0.1% or less,
Cr of 20.5% to 22.5%,
Cu of 0.3% to 0.8%,
Ni of 1.0% or less,
Ti of 4×(C %+N %) to 0.35%,
Nb of less than 0.01%,
N of 0.03% or less,
optionally at least one of 0.0002 to 0.002% of B, 0.01 to 0.5% of V or 0.01 to 0.5% of Zr, and
C+N of 0.05% or less, and
the remainder of the steel sheet being Fe and inevitable impurities; wherein the following equation (1) is satisfied, $$240+35\times(Cr\ \%-20.5)+280\times\{Ti\ \%-4\times(C\ \%+N\ \%)\}\geqq 280 \quad (1),$$

wherein C %, N %, Cr % and Ti % indicate the content (mass percent) of C, N, Cr and Ti, respectively, and the steel sheet has a pitting potential equivalent of 280 or more.

2. A method of manufacturing a ferritic stainless steel sheet having excellent corrosion resistance:

hot rolling a material consisting of:
C of 0.03% or less,
Si of 1.0% or less,
Mn of 0.5% or less,
P of 0.04% or less,
S of 0.02% or less,
Al of 0.1% or less,
Cr of 20.5% to 22.5%,
Cu of 0.3% to 0.8%,
Ni of 1.0% or less,
Ti of 4×(C %+N %) to 0.35%,
Nb of less than 0.01%,
N of 0.03% or less,
optionally at least one of 0.0002 to 0.002% of B, 0.01 to 0.5% of V or 0.01 to 0.5% of Zr, and
C+N of 0.05% or less, and
the remainder of the steel sheet being Fe and inevitable impurities, in which the following equation (1) is satisfied, $$240+35\times(Cr\ \%-20.5)+280\times\{Ti\ \%-4\times(C\ \%+N\ \%)\}\geqq 280 \quad (1),$$

wherein C %, N %, Cr % and Ti % indicate the content of C, N, Cr and Ti (mass percent), respectively, into a hot-rolled sheet;
continuously annealing the hot-rolled sheet into an annealed sheet at a temperature of 800 to 1000° C.;
pickling the annealed sheet;
cold-rolling the annealed sheet to form a cold-rolled sheet; and
annealing and pickling the cold-rolled sheet in a high speed continuous annealing line for combined use with carbon steel such that the steel sheet has a pitting potential equivalent of 280 or more.

3. A ferritic stainless steel sheet having excellent corrosion resistance comprising:

C of 0.03% or less,
Si of 1.0% or less,
Mn of 0.5% or less,
P of 0.04% or less,
S of 0.02% or less,
Al of 0.1% or less,
Cr of 20.5% to 22.5%,
Cu of 0.3% to 0.8%,
Ni of 1.0% or less,
Ti of 4×(C %+N %) to 0.35%,
Nb of less than 0.01%,
N of 0.03% or less,
optionally at least one of 0.0002 to 0.002% of B, 0.01 to 0.5% of V or 0.01 to 0.5% of Zr, and
C+N of 0.05% or less, and
the steel sheet having
the remainder including Fe and inevitable impurities;
wherein the following equation (1) is satisfied, $$240+35\times(Cr\ \%-20.5)+280\times\{Ti\ \%-4\times(C\ \%+N\ \%)\}\geqq 280 \quad (1),$$

wherein C %, N %, Cr % and Ti % indicate the content (mass percent) of C, N, Cr and Ti, respectively, and the steel sheet has a pitting potential equivalent of 280 or more.

4. A method of manufacturing a ferritic stainless steel sheet having excellent corrosion resistance:

hot rolling a material comprising:
C of 0.03% or less,
Si of 1.0% or less,
Mn of 0.5% or less,
P of 0.04% or less,
S of 0.02% or less,
Al of 0.1% or less,
Cr of 20.5% to 22.5%,
Cu of 0.3% to 0.8%,
Ni of 1.0% or less,
Ti of 4×(C %+N %) to 0.35%,
Nb of less than 0.01%,
N of 0.03% or less, optionally at least one of 0.0002 to 0.002% of B, 0.01 to 0.5% of V or 0.01 to 0.5% of Zr, and C+N of 0.05% or less, and the steel sheet having the remainder including Fe and inevitable impurities, in which the following equation (1) is satisfied, $$240+35\times(Cr\,\%-20.5)+280\times\{Ti\,\%-4\times(C\,\%+N\,\%)\}\geqq 280 \quad (1),$$

wherein C %, N %, Cr % and Ti % indicate the content of C, N, Cr and Ti (mass percent), respectively, into a hot-rolled sheet;

continuously annealing the hot-rolled sheet into an annealed sheet at a temperature of 800 to 1000° C.;

pickling the annealed sheet;

cold-rolling the annealed sheet to form a cold-rolled sheet; and annealing and pickling the cold-rolled sheet in a high speed continuous annealing line for combined use with carbon steel such that the steel sheet has a pitting potential equivalent of 280 or more.

* * * * *